US011411340B2

(12) United States Patent
Chen

(10) Patent No.: US 11,411,340 B2
(45) Date of Patent: Aug. 9, 2022

(54) SEAMLESS METALLIC OUTER SHELL OF AN ELECTRICAL CONNECTOR HAVING INWARD BULGES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Ming-Ching Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/074,589

(22) Filed: Oct. 19, 2020

(65) Prior Publication Data

US 2021/0119366 A1 Apr. 22, 2021

(30) Foreign Application Priority Data

Oct. 17, 2019 (CN) ..... 201921747783.4

(51) Int. Cl.

| | |
|---|---|
| ***H01R 13/40*** | (2006.01) |
| ***H01R 13/24*** | (2006.01) |
| ***H01R 43/16*** | (2006.01) |
| ***H01R 43/18*** | (2006.01) |

(52) U.S. Cl.

CPC ..... *H01R 13/40* (2013.01); *H01R 13/2435* (2013.01); *H01R 13/2492* (2013.01); *H01R 43/16* (2013.01); *H01R 43/18* (2013.01)

(58) Field of Classification Search

CPC ..... H01R 13/40; H01R 13/2435; H01R 13/2492; H01R 43/16; H01R 43/18

USPC ..... 439/750

See application file for complete search history.

(56) References Cited

U.S. PATENT DOCUMENTS

| | | | | |
|---|---|---|---|---|
| 6,474,995 | B1 * | 11/2002 | Wu | H01R 24/50 439/63 |
| 6,648,653 | B2 * | 11/2003 | Huang | H01R 24/50 439/582 |
| 7,118,383 | B2 | 10/2006 | Nagata et al. | |
| 7,334,327 | B1 * | 2/2008 | Chen | H01R 43/24 264/104 |
| 7,484,965 | B2 * | 2/2009 | Chien | H01R 24/50 439/63 |

(Continued)

FOREIGN PATENT DOCUMENTS

| | | |
|---|---|---|
| CN | 204045745 U | 12/2014 |
| TW | M388157 U1 | 9/2010 |

*Primary Examiner* — Peter G Leigh

(74) *Attorney, Agent, or Firm* — Ming Chieh Chang; Wei Te Chung

(57) ABSTRACT

An electrical connector includes: an insulative housing having a base; a center conductor secured to the insulative housing; and a metallic shell secured to the insulative housing and surrounding the center conductor, the metallic shell including a sleeve having a lower part secured to the base of the insulative housing and an upper part extending upwardly beyond the base of the insulative housing; wherein the insulative housing is insert-molded with the center conductor and the metallic shell; and the sleeve of the metallic shell is formed as a seamless structure.

11 Claims, 9 Drawing Sheets

(56) References Cited

U.S. PATENT DOCUMENTS

| | | | | |
|---|---|---|---|---|
| 7,648,394 | B2 * | 1/2010 | Yotsutani | H01R 12/718 439/581 |
| 7,699,652 | B2 * | 4/2010 | Yotsutani | H01R 12/718 439/581 |
| 8,038,450 | B2 * | 10/2011 | Nakagawa | H01R 24/50 439/63 |
| 8,444,422 | B2 * | 5/2013 | Lin | H01R 24/50 439/63 |
| 8,944,827 | B2 * | 2/2015 | Ohsaka | H01R 12/57 439/63 |
| 9,305,720 | B2 * | 4/2016 | Chen | H01H 9/02 |
| 9,450,342 | B2 * | 9/2016 | Wu | H01R 13/6593 |
| 10,008,800 | B2 | 6/2018 | Inoue | |
| 10,158,200 | B2 * | 12/2018 | Miyazaki | H01R 12/75 |
| 2009/0197432 | A1 * | 8/2009 | Li | H01R 24/50 439/63 |
| 2010/0190376 | A1 * | 7/2010 | Chen | H01R 24/50 439/578 |
| 2010/0248503 | A1 * | 9/2010 | Kang | H01R 24/50 439/63 |
| 2013/0224991 | A1 * | 8/2013 | Lee | H01R 24/46 439/519 |
| 2015/0056866 | A1 * | 2/2015 | Osaki | H01R 13/6277 439/675 |

* cited by examiner

SEAMLESS METALLIC OUTER SHELL OF AN ELECTRICAL CONNECTOR HAVING INWARD BULGES

BACKGROUND OF THE INVENTION

1. Field of the Invention

The present invention relates to an electrical connector comprising an insulative housing, a center conductor secured to the insulative housing, and a metallic shell secured to the insulative housing and surrounding the center conductor, wherein the metallic shell includes a sleeve having a lower part secured to the insulative housing and an upper part provided with features for reliably retaining to a corresponding shell of a complementary electrical connector. This application relates to the copending application with the same inventor and the same filing date and a title of METALLIC OUTER SHELL OF AN ELECTRICAL CONNECTOR HAVING CURVILINEAR FLAPS AND INTERPOSED SPRINGY FLAPS.

2. Description of Related Arts

Taiwan Patent No. 388157 discloses an electrical connector comprising an insulative housing, a center conductor (2) secured to the insulative housing, and a metallic shell secured to the insulative housing and surrounding the center conductor, wherein an upper part of the metallic shell includes a plurality of spring flaps and the metallic shell is so formed as to have a seam. China Patent No. 204045745 discloses a multi-lobe contact elastic arm terminal that is formed by a drawing operation to have low height and small dimension while achieving multi-point elastic contact during mating with a complementary pin terminal.

SUMMARY OF THE INVENTION

An electrical connector comprises: an insulative housing having a base; a center conductor secured to the insulative housing; and a metallic shell secured to the insulative housing and surrounding the center conductor, the metallic shell including a sleeve having a lower part secured to the base of the insulative housing and an upper part extending upwardly beyond the base of the insulative housing; wherein the insulative housing is insert-molded with the center conductor and the metallic shell; and the sleeve of the metallic shell is formed as a seamless structure.

DETAILED DESCRIPTION OF THE PREFERRED EMBODIMENTS

Figure 1:
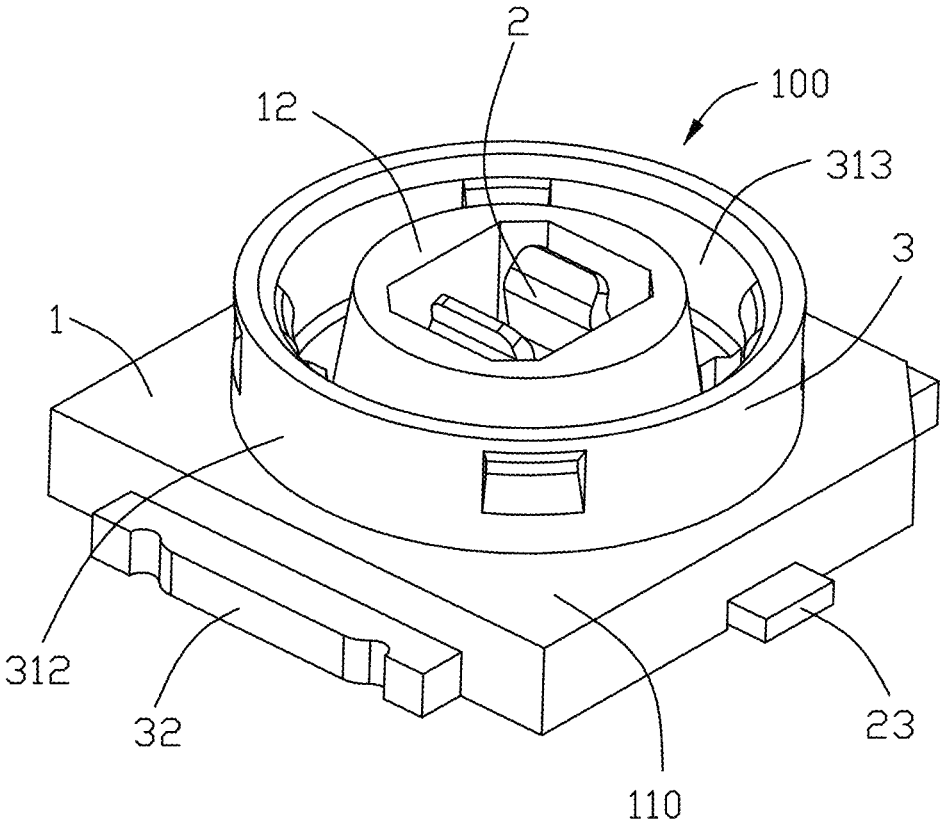
FIG. 1 is a perspective view of an electrical connector in accordance with the present invention.
Figure 2:
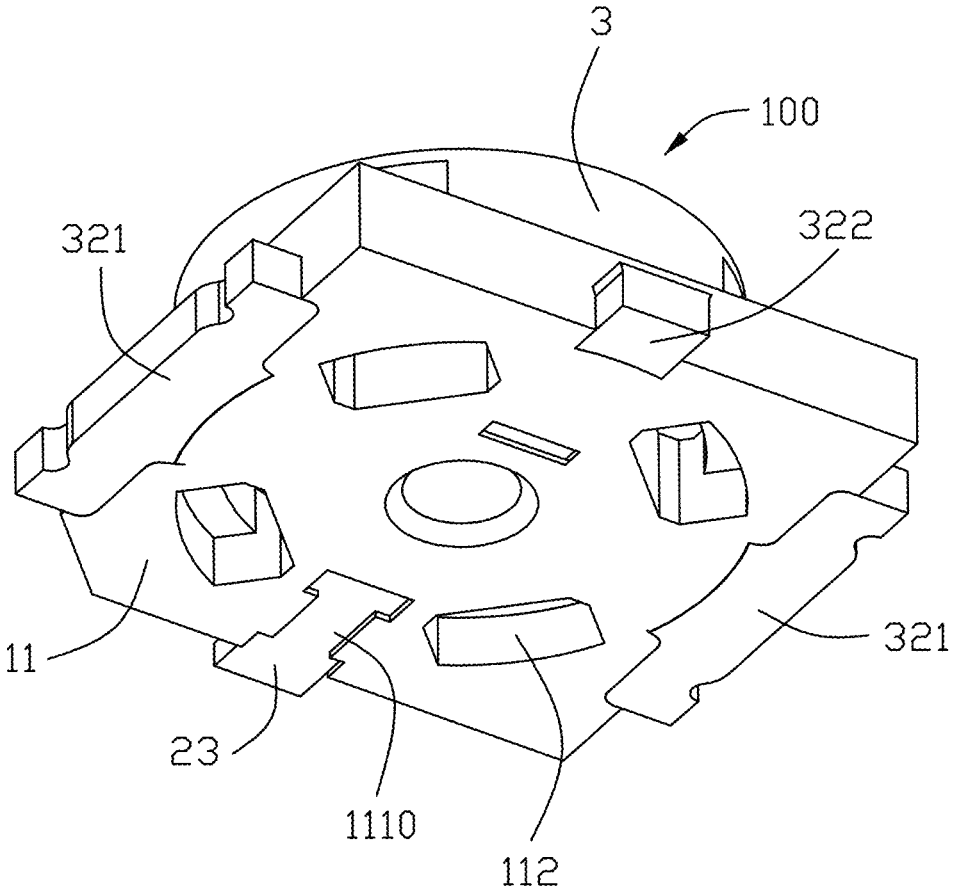
FIG. 2 is another perspective view of the electrical connector.
Figure 3:
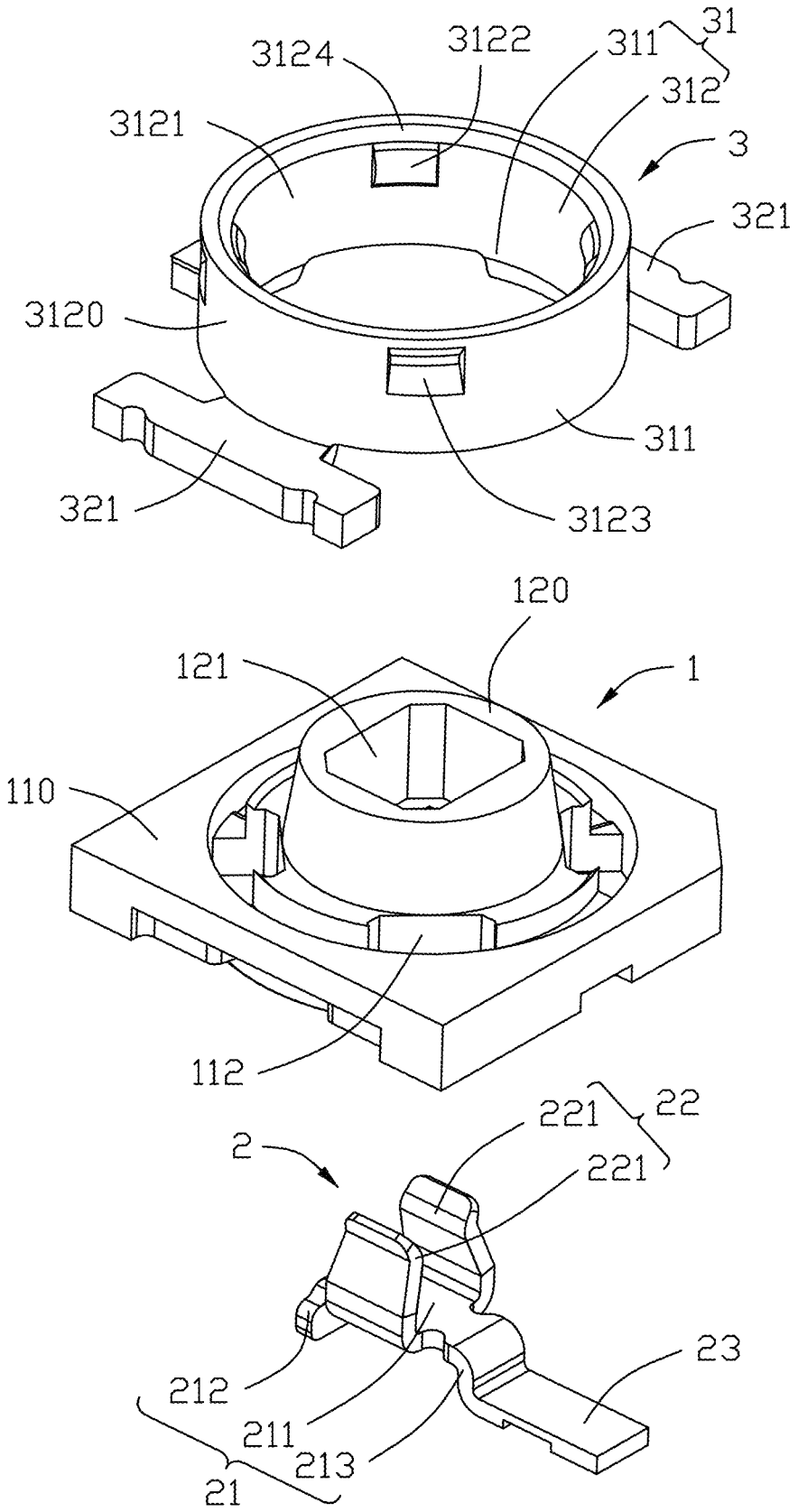
FIG. 3 is an exploded view of the electrical connector.
Figure 4:
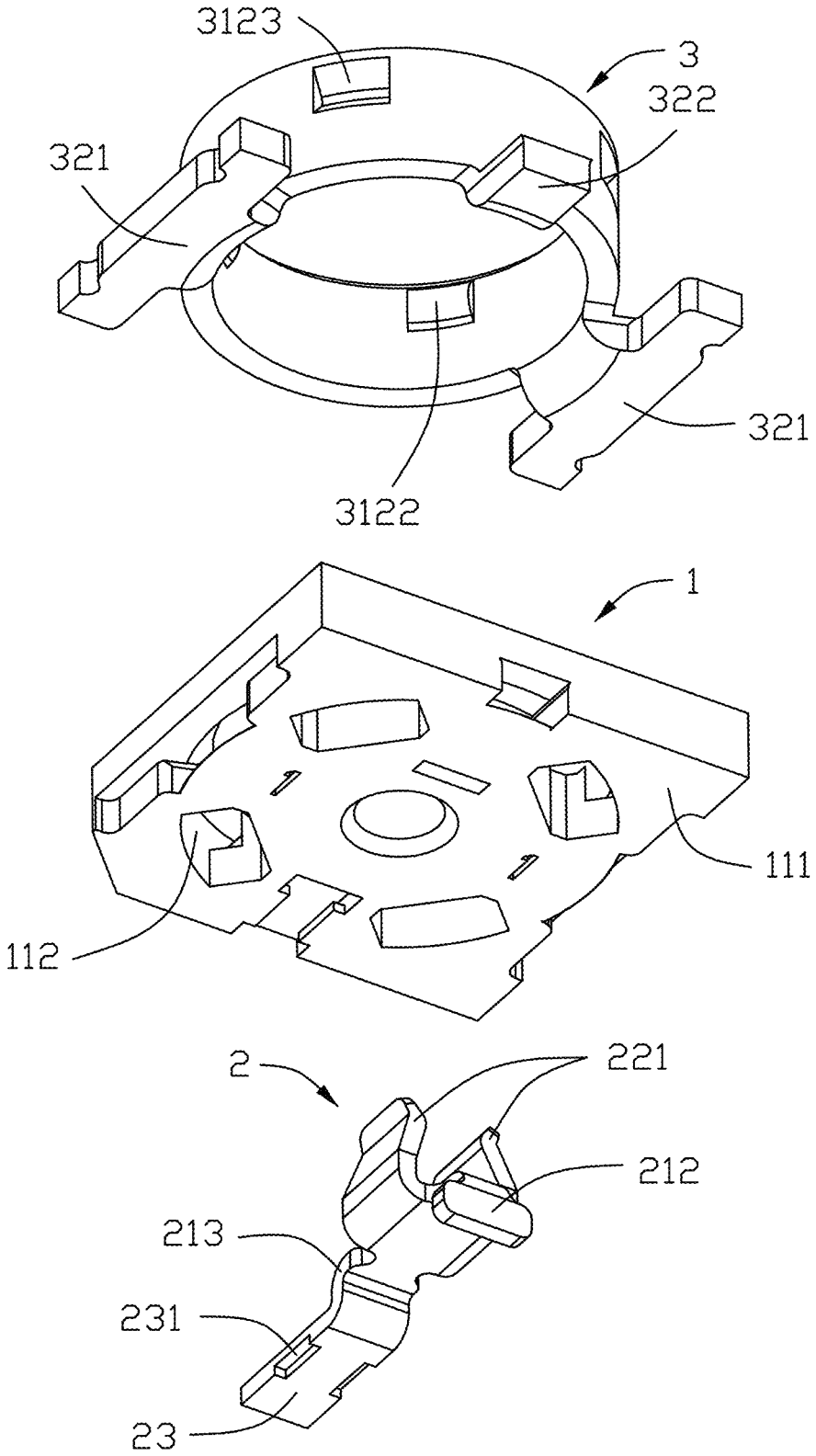
FIG. 4 is another exploded view of the electrical connector.
Figure 5:
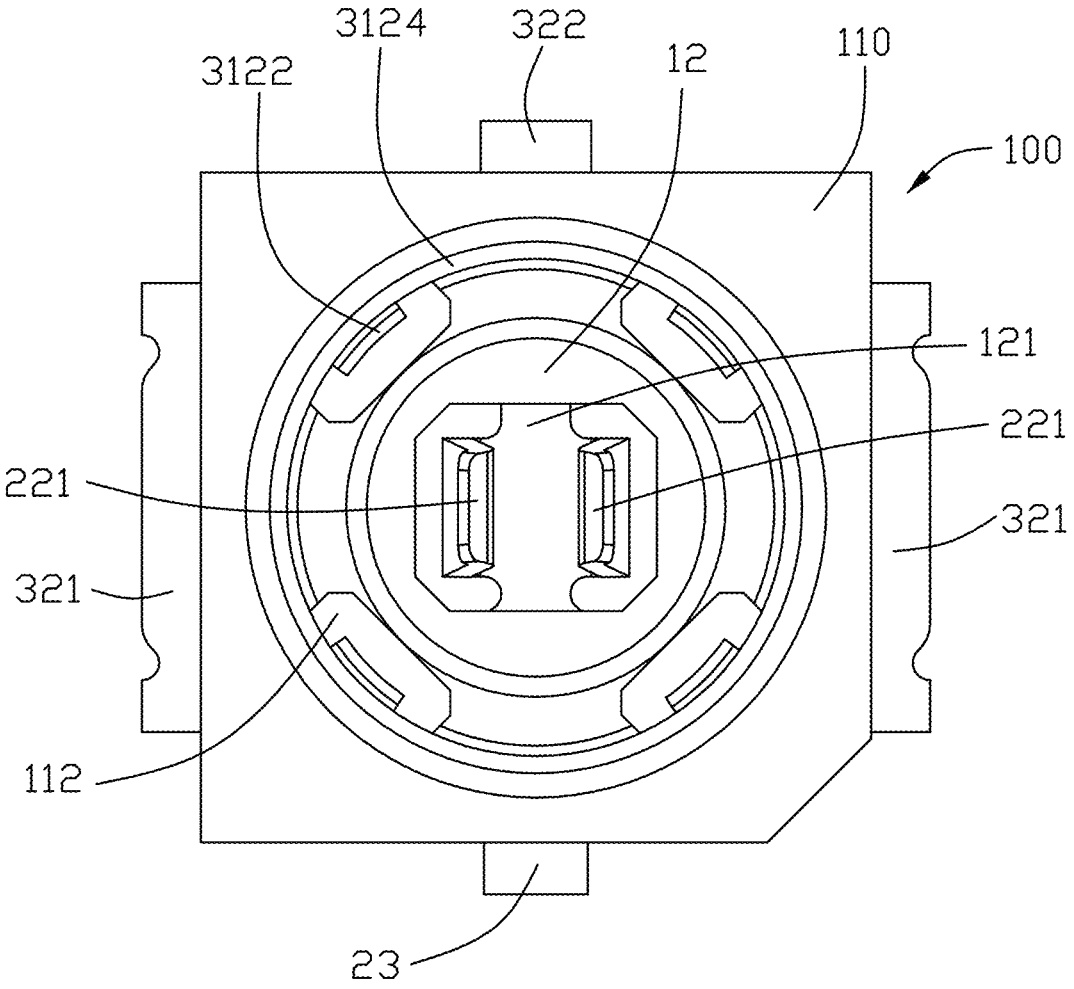
FIG. 5 is a top view of the electrical connector.
Figure 6:
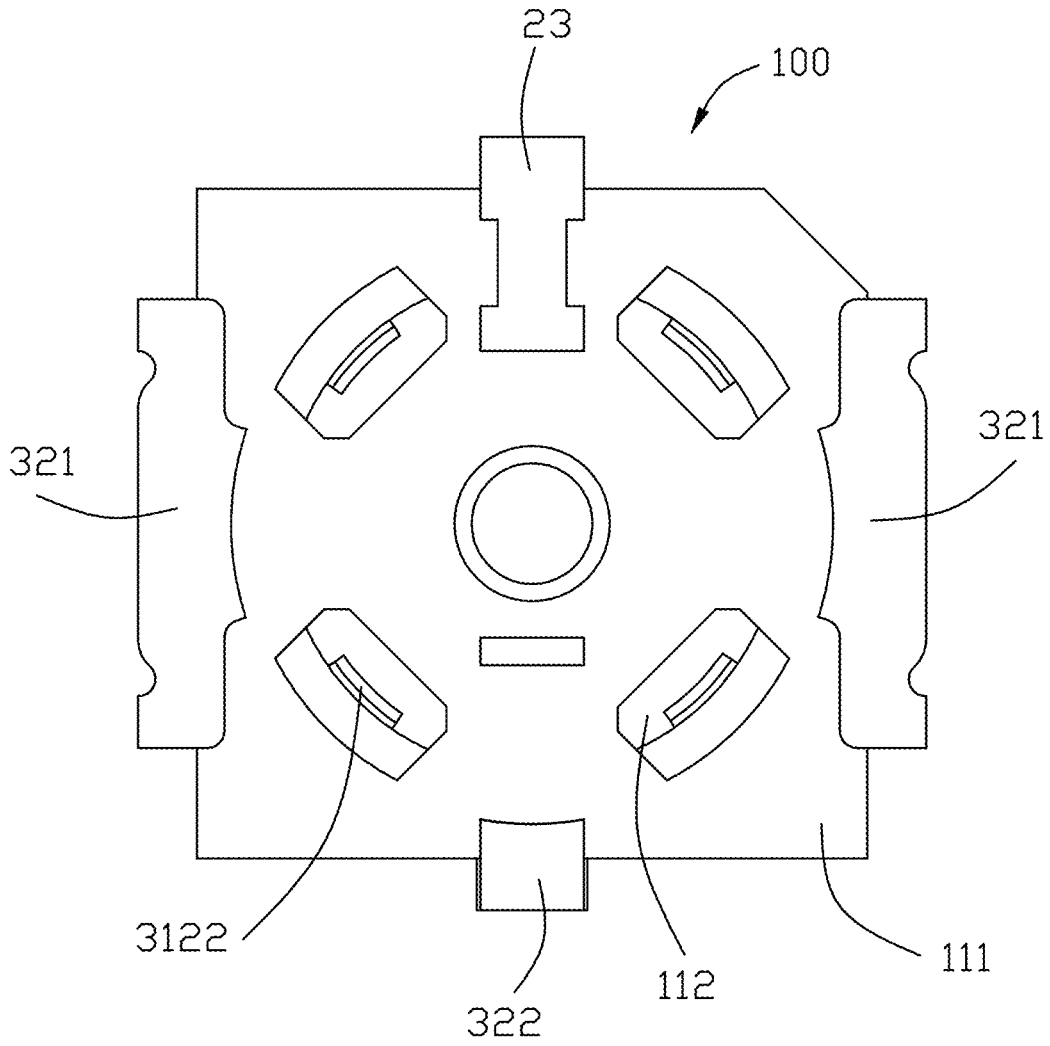
FIG. 6 is bottom view of the electrical connector.

Referring to FIGS. 1-9, an electrical connector 100 to be mounted to a printed circuit board for coupling to a complementary coaxial connector comprises an insulative housing 1, a center conductor 2 secured to the insulative housing 1, and a metallic shell 3 also secured to the insulative housing 1. In the embodiment shown, the insulative housing 1 is insert-molded with the center conductor 2 and the metallic shell 3.

The insulative housing 1 includes a base 11. The base 11 has a top end face 110 and a bottom end face 111. The center conductor 2 has a main portion 21, a contact portion 22 extending upward from the main portion 21 beyond the top end face 110 of the base 11, and a soldering portion 23 extending horizontally outwardly from the main portion 21. The metallic shell 3 includes a sleeve 31 surrounding the center conductor 2 and a plurality of soldering legs 32. The soldering legs 32 include a pair of first legs 321 and a second leg 322.

The sleeve 31 of the metallic shell 3 is formed as a seamless structure by a metal drawing process to have an increased structural strength. The sleeve 31 of the metallic shell 3 may alternatively be formed metallurgically to have a seamless body. The sleeve 31 has a lower part 311 secured to the base 11 of the insulative housing 1 and an upper part 312 extending upwardly beyond the top end face 110 of the base 11. The seamless upper part 312 is sufficiently rigid to not easily deform during mating with a complementary electrical connector.

The upper part 312 has an outer wall face 3120 and an inner wall face 3121. A plurality of inward bulges 3122 are formed, e.g., by stamping prior to the metal drawing process, on the inner wall face 3121 of the upper part 312, leaving corresponding depressions 3123 on the outer wall face 3120 thereof. The bulges 3122 will retain to a corresponding shell of the complementary electrical connector. The base 11 has slots 112 extending through the top and bottom end faces 110 and 111 and aligned with the inward bulges 3122. The upper part 312 has a chamfer 3124 at an upper inner edge thereof immediately adjacent to the bulges 3122 so as to have a feel of smooth transition from the chamfer 3124 to the inward bulges 3122 during mating with a complementary electrical connector.

The insulative housing 1 has a post 12 extending upward from the base 11. The post 12 has a hole 121 through its top surface 120 and the contact portion 22 of the center conductor 2 is positioned in the hole 121. The upper part 312 surrounds the post 12 to define a groove 313. The contact portion 22 has a pair of arms 221 enclosed by the post 12. The main portion 21 has a planar portion 211 and two opposite first and second vertical portions 212 and 213. The pair of arms 221 extend from the other two opposite sides of the planar portion 211. The vertical portions 212 and 213 are embedded in the base 11 and the soldering portion 23 exposes outside the bottom end face 111 of the base 11. The portion 23 has a pair of notches 231 for reliable bonding with the base 11.

Figure 7:
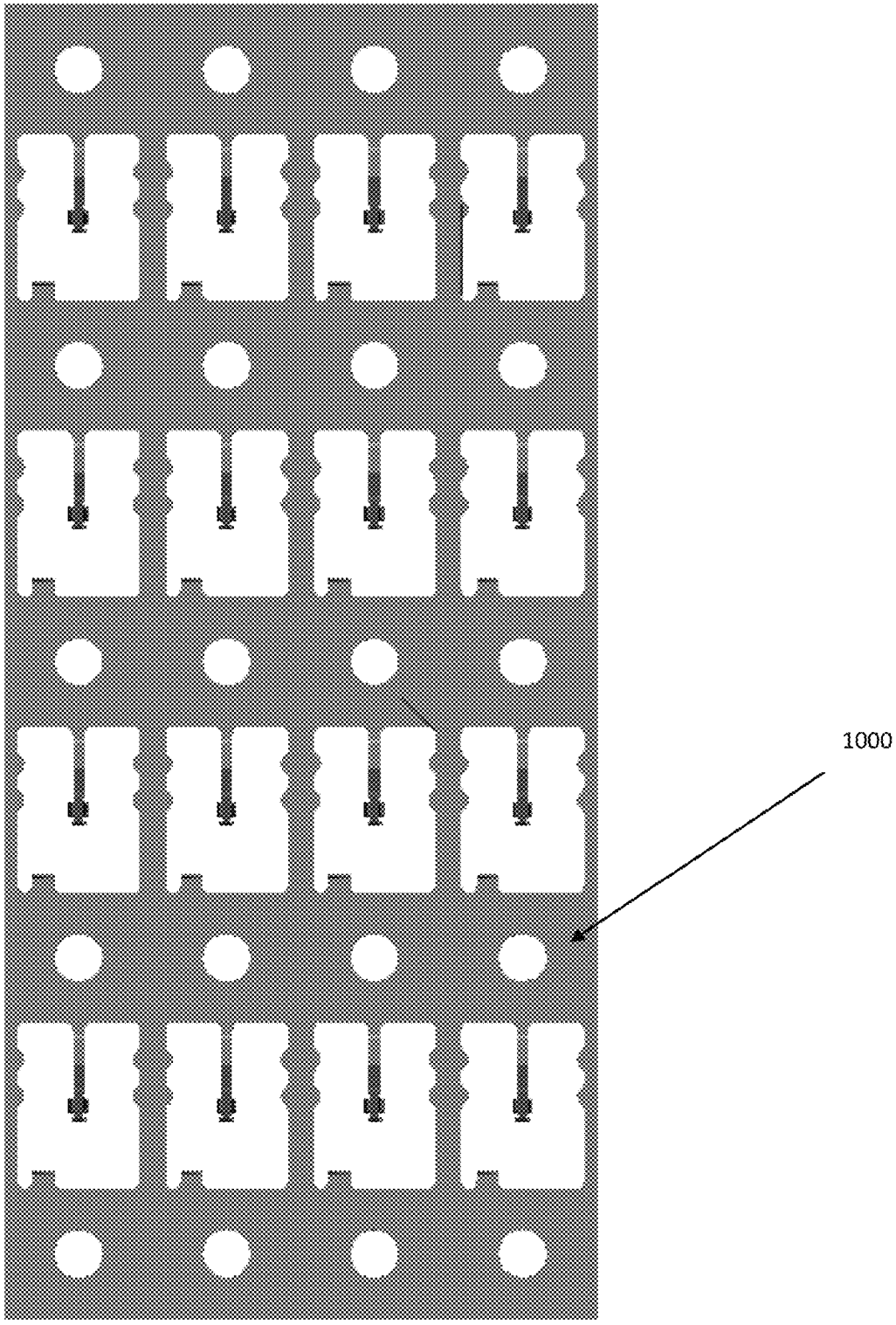
FIG. 7 is a top view of a plurality of center conductors unitarily formed on a first metal sheet via stamping and forming.
Figure 8:
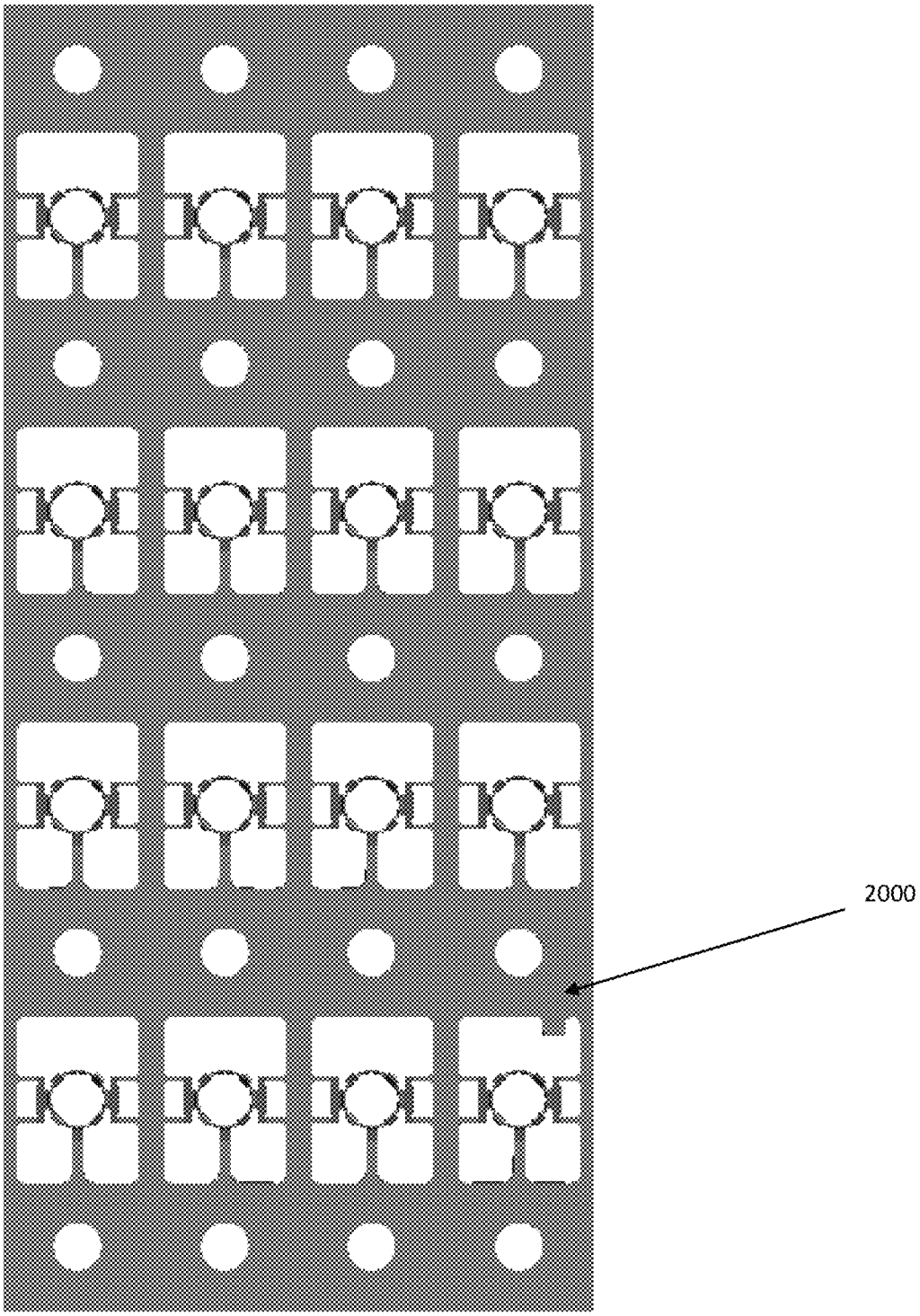
FIG. 8 is a top view of a plurality of metallic shell unitarily formed on a second metal sheet via stamping and drawing.
Figure 9:
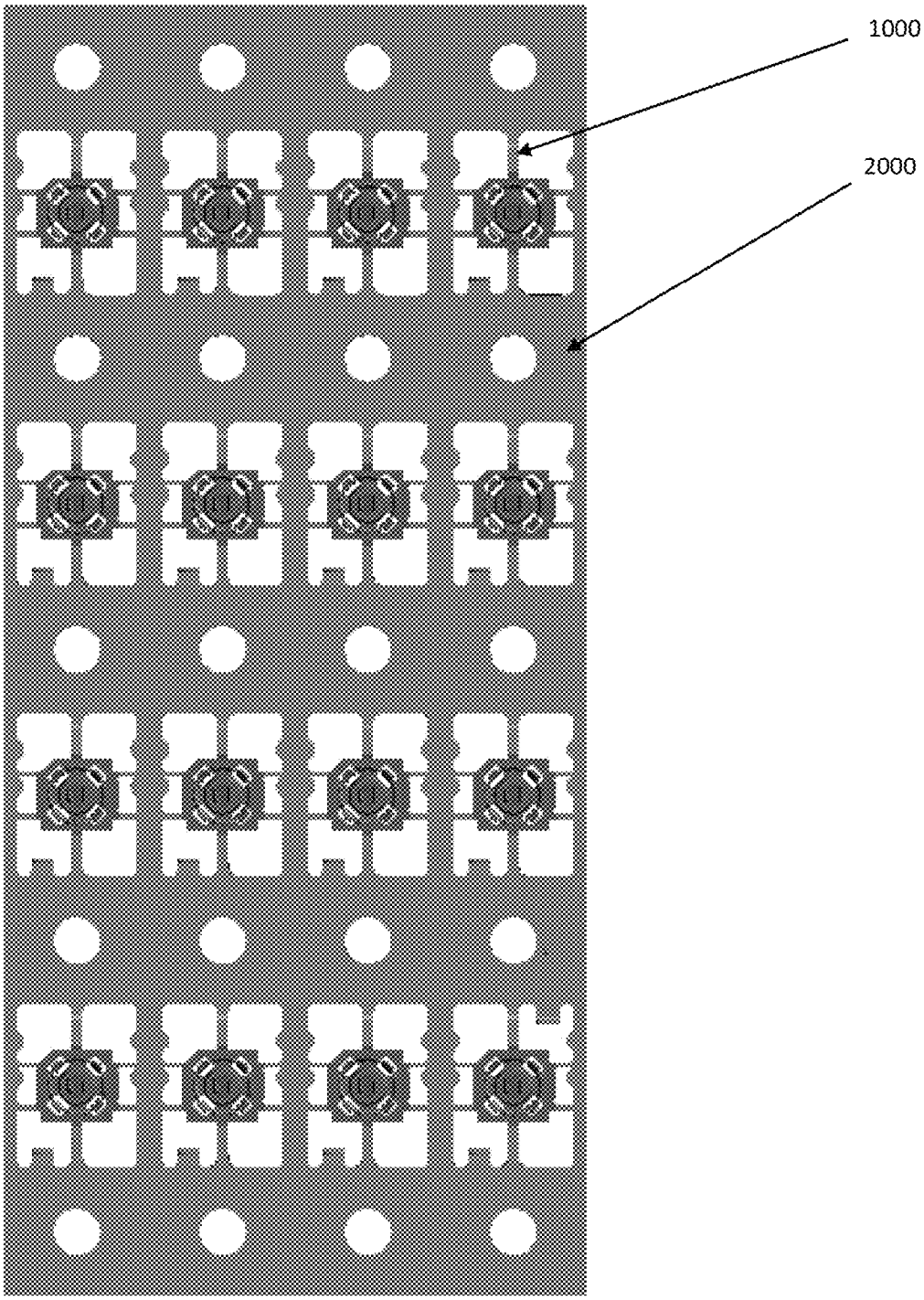
FIG. 9 is a top view of the stacked first metal sheet and second metal sheet and integrally formed with the corresponding housings via insert-molding.

As shown in FIGS. 7-9, for making the connectors, a plurality of center conductors 2 are originally unitarily formed on a first metal sheet 1000 via stamping and forming wherein each center conductor 2 is linked to the metal sheet via one first linking bar (not labeled) (FIG. 7); a plurality of metallic shells 3 are unitarily formed on a second metal sheet 2000 via stamping and drawing (FIG. 8) wherein each metallic shell 3 is linked to the second metal sheet via three second linking bars (not labeled) (FIG. 8). Successively, the second metal sheet 2000 is stacked upon the first metal sheet 1000 with the center conductors 2 being surrounded within the corresponding metallic shells 3 respectively, and commonly further integrally formed with the corresponding housings 1 via an insert-molding process so as to form a plurality of connectors 100 (FIG. 9). At last, each connector 100 is removed away from the first metal sheet 1000 and the second metal sheet 2000 by breaking from the corresponding four linking bars (not labeled). Notably, via the instant method, it is allowed to simultaneously form N×M connectors in matrix via insert-molding wherein both N and M are integers which are larger than two, compared with the traditional method which only allows one row manufacturing instead of the matrix type manufacturing of the instant invention. Notably, the first linking bar is not aligned/overlapped with any of the three second linking bars in the vertical direction, and those three second linking bars are spaced from one another with ninety-degree intervals.

What is claimed is:

1. An electrical connector comprising:

an insulative housing having a base;

a center conductor secured to the insulative housing; and a metallic shell secured to the insulative housing and surrounding the center conductor, the metallic shell including a sleeve having a lower part secured to the base of the insulative housing and an upper part extending upwardly beyond the base of the insulative housing; wherein the insulative housing is insert-molded with the center conductor and the metallic shell; and the sleeve of the metallic shell is formed as a seamless structure.

2. The electrical connector as claimed in claim 1, wherein the seamless structure of the sleeve is formed by a metal drawing process.

3. The electrical connector as claimed in claim 1, wherein the upper part of the sleeve has a plurality of inward bulges.

4. The electrical connector as claimed in claim 3, wherein the upper part has a chamfer at an upper inner edge thereof immediately adjacent to the inward bulges so as to obtain a feel of smooth transition from the chamfer to the inward bulges during mating with a complementary electrical connector.

5. The electrical connector as claimed in claim 1, wherein the insulative housing has a post extending upward from the base, and the center conductor has a pair of contact arms positioned in a hole of the post.

6. A method of making electrical connectors comprising steps of:

providing a first metal sheet unitarily formed with a plurality of center conductors in matrix;

providing a second metal sheet unitarily formed with a plurality of metallic shells in matrix wherein each metallic shell includes a seamless sleeve via a corresponding drawing process;

stacking the first metal sheet and the second metal sheet together in a vertical direction to have the center conductors aligned and surrounded within the corresponding sleeves, respectively; and providing a plurality of insulative housings each integrally formed with both the corresponding center conductor and the corresponding metallic shell via insert-molding to form each corresponding connector; wherein the center conductor is linked to the first metal sheet via a first linking bar while the metallic shell is linked to the second metal sheet via a second linking bar, the first linking bar is not aligned or overlapped with the second linking bar in the vertical direction, and the second linking bar includes three parts spaced from one another with ninety-degree intervals.

7. The method as claimed in claim 6, further including a step of removing said the first linking bar originally linked to the center conductor and the second linking bar originally linked to the metallic shell from the respective housing for each connector.

8. The method as claimed in claim 6, wherein the second metal sheet is stacked upon the first metal sheet.

9. The method as claimed in claim 6, wherein an upper part of the sleeve includes a plurality of inward bulges.

10. The method as claimed in claim 6, wherein the matrix defined in the first metal sheet is of M×N, and both M and N are integers greater than two.

11. A method of making electrical connectors, comprising the steps of:

providing a first metal sheet unitarily formed with a plurality of center conductors in a matrix;

providing a second metal sheet unitarily formed with a plurality of metallic shells in a matrix wherein each metallic shell includes a seamless sleeve via a corresponding drawing process;

stacking the first metal sheet and the second metal sheet together in a vertical direction to have the center conductors aligned and surrounded within the corresponding sleeves, respectively; and providing a plurality of insulative housings each integrally formed with both the corresponding center conductor and the corresponding metallic shell via insert-molding to form each corresponding connector; wherein the matrix defined in the first metal sheet is of M×N and both M and N are integers greater than two.

* * * * *